US009187980B2

(12) United States Patent
McHugh et al.

(10) Patent No.: US 9,187,980 B2
(45) Date of Patent: Nov. 17, 2015

(54) SYSTEM AND METHOD OF PROVIDING HIGH PRESSURE FLUID INJECTION WITH METERING USING LOW PRESSURE SUPPLY LINES

(75) Inventors: Edmund Peter McHugh, Longford Town (IE); Chris Kocurek, Houston, TX (US)

(73) Assignee: OneSubsea IP UK Limited, London (GB)

( * ) Notice: Subject to any disclaimer, the term of this patent is extended or adjusted under 35 U.S.C. 154(b) by 755 days.

(21) Appl. No.: 13/257,953

(22) PCT Filed: Apr. 21, 2010

(86) PCT No.: PCT/US2010/031963

§ 371 (c)(1),
(2), (4) Date: Sep. 20, 2011

(87) PCT Pub. No.: WO2010/129178

PCT Pub. Date: Nov. 11, 2010

(65) Prior Publication Data

US 2012/0006556 A1 Jan. 12, 2012

Related U.S. Application Data

(60) Provisional application No. 61/175,386, filed on May 4, 2009.

(51) Int. Cl.

| | |
|---|---|
| ***E21B 7/12*** | (2006.01) |
| ***E21B 37/06*** | (2006.01) |
| ***E21B 33/076*** | (2006.01) |

(Continued)

(52) U.S. Cl.
CPC ..... *E21B 37/06* (2013.01); *E21B 33/076* (2013.01); *E21B 43/16* (2013.01); *E21B 43/25* (2013.01)

(58) Field of Classification Search
CPC ..... E21B 43/26; E21B 43/16
USPC ..... 166/344, 351, 263, 369, 90.1
See application file for complete search history.

(56) References Cited

U.S. PATENT DOCUMENTS

| | | | |
|---|---|---|---|
| 3,935,903 | A | 2/1976 | Arendt |
| 4,315,523 | A | 2/1982 | Mahawili et al. |

(Continued)

FOREIGN PATENT DOCUMENTS

| | | |
|---|---|---|
| EP | 1355166 | 10/2003 |
| GB | 2419905 | 5/2006 |

(Continued)

OTHER PUBLICATIONS

PCT/US2010/031963 Search Report and Written Opinion dated Nov. 3, 2010.

(Continued)

*Primary Examiner* — Matthew Buck
*Assistant Examiner* — Aaron Lembo
(74) *Attorney, Agent, or Firm* — Fletcher Yoder P.C.

(57) ABSTRACT

An apparatus that includes a chemical-injection management system of a sub-sea oil and gas extraction system. The chemical-injection management system may include a flow path having an inlet and an outlet. The chemical-injection management system may also include a pump disposed in the flow path between the inlet and the outlet; wherein the pump is configured to increase the pressure of a fluid flow through the flow path.

24 Claims, 8 Drawing Sheets

(51) Int. Cl.

| | |
|---|---|
| ***E21B 43/16*** | (2006.01) |
| ***E21B 43/25*** | (2006.01) |

(56) References Cited

U.S. PATENT DOCUMENTS

| | | | | |
|---|---|---|---|---|
| 4,391,150 | A | 7/1983 | Rey | |
| 4,988,389 | A | 1/1991 | Adamache et al. | |
| 5,194,012 | A * | 3/1993 | Cairns | 439/201 |
| 5,558,532 | A | 9/1996 | Hopper | |
| 5,794,701 | A | 8/1998 | Cunningham et al. | |
| 5,973,441 | A * | 10/1999 | Lo et al. | 310/330 |
| 6,325,159 | B1 * | 12/2001 | Peterman et al. | 175/7 |
| 6,354,146 | B1 | 3/2002 | Birchak et al. | |
| 6,429,926 | B1 | 8/2002 | Williamson et al. | |
| 6,481,504 | B1 | 11/2002 | Gatherar | |
| 6,644,119 | B1 | 11/2003 | Sinha | |
| 6,823,941 | B2 | 11/2004 | Donald | |
| 6,851,444 | B1 | 2/2005 | Kohl et al. | |
| 7,234,524 | B2 | 6/2007 | Shaw et al. | |
| 7,243,729 | B2 | 7/2007 | Tyrrell et al. | |
| 7,380,835 | B2 | 6/2008 | McCoy et al. | |
| 7,389,787 | B2 | 6/2008 | Means et al. | |
| 8,066,076 | B2 | 11/2011 | Donald et al. | |
| 8,327,875 | B2 | 12/2012 | Grace et al. | |
| 8,763,693 | B2 | 7/2014 | McHugh et al. | |
| 2002/0011336 | A1 | 1/2002 | Baskett | |
| 2002/0070026 | A1 | 6/2002 | Fenton et al. | |
| 2002/0089659 | A1 | 7/2002 | Williamson et al. | |
| 2003/0024704 | A1 | 2/2003 | Hirsch et al. | |
| 2004/0226360 | A1 | 11/2004 | Lotters | |
| 2004/0253734 | A1 | 12/2004 | Firmin | |
| 2004/0262008 | A1 | 12/2004 | Deans et al. | |
| 2005/0028984 | A1 | 2/2005 | Donald et al. | |
| 2005/0166961 | A1 | 8/2005 | Means et al. | |
| 2006/0037644 | A1 | 2/2006 | Nishikawa et al. | |
| 2006/0096760 | A1 | 5/2006 | Ohmer | |
| 2007/0289740 | A1 | 12/2007 | Thigpen et al. | |
| 2008/0148841 | A1 | 6/2008 | Sakai | |
| 2008/0163692 | A1 | 7/2008 | Huang et al. | |
| 2008/0217022 | A1 | 9/2008 | Deans | |
| 2008/0257032 | A1 | 10/2008 | Zollo et al. | |
| 2008/0304979 | A1 * | 12/2008 | Lucas | 417/327 |
| 2009/0025936 | A1 | 1/2009 | Donald et al. | |
| 2010/0126600 | A1 | 5/2010 | Watson | |
| 2011/0264373 | A1 * | 10/2011 | Hehmeyer et al. | 702/13 |
| 2012/0312522 | A1 | 12/2012 | Quin et al. | |
| 2012/0325488 | A1 | 12/2012 | Grace et al. | |
| 2014/0262987 | A1 | 9/2014 | McHugh et al. | |

FOREIGN PATENT DOCUMENTS

| | | | |
|---|---|---|---|
| WO | WO0037770 | | 6/2000 |
| WO | 2004016904 | | 2/2004 |
| WO | 2008081164 | A1 | 7/2008 |
| WO | WO2008095113 | | 8/2008 |

OTHER PUBLICATIONS

Great Britain Examination Report; Application No. GB 1120434.4; Dated Sep. 2, 2013; 2 pages.

Singapore Examination Report; Application No. SG 201107043-0; Dated Dec. 12, 2012; 5 pages.

* cited by examiner

SYSTEM AND METHOD OF PROVIDING HIGH PRESSURE FLUID INJECTION WITH METERING USING LOW PRESSURE SUPPLY LINES

CROSS REFERENCE TO RELATED APPLICATIONS

This application claims priority to and benefit of PCT Patent Application No. PCT/US2010/031963, entitled "System and Method of Providing High Pressure Fluid Injection with Metering Using Low Pressure Supply Lines", filed on Apr. 21, 2010, which is herein incorporated by reference in its entirety, and which claims priority to and benefit of U.S. Provisional Patent Application No. 61/175,386, entitled "System and Method of Providing High Pressure Fluid Injection with Metering Using Low Pressure Supply Lines", filed on May 4, 2009, which is herein incorporated by reference in its entirety.

FIELD OF THE INVENTION

The present invention relates to chemical-injection management systems. More particularly, the present invention relates to high-pressure chemical-injection management systems having a pump contained therein and configured to operate with low pressure supply lines.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are often used to access resources below the surface of the earth. For instance, oil, natural gas, and water are often extracted via a well. Some wells are used to inject materials below the surface of the earth, e.g., to sequester carbon dioxide, to store natural gas for later use, or to inject steam or other substances near an oil well to enhance recovery. Due to the value of these subsurface resources, wells are often drilled at great expense, and great care is typically taken to extend their useful life.

Chemical-injection management systems are often used to maintain a well and/or enhance throughput of a well. For example, chemical-injection management systems are used to inject corrosion-inhibiting materials, foam-inhibiting materials, wax-inhibiting materials, and/or antifreeze to extend the life of a well or increase the rate at which resources are extracted from a well. Typically, these materials are injected into the well in a controlled manner over a period of time by the chemical-injection management system.

The life of a chemical-injection management system may be limited by its mechanical components, such as gearboxes, motors, and valves that can wear out. Further, sensors and actuators used to control flow rate can drift over time, and, as a result, the accuracy of the chemical-injection management system can decline. These problems may be particularly acute in sub-sea applications, where the chemical-injection management system may be difficult and/or expensive to access. Replacing a worn out or inaccurate chemical-injection management system can significantly add to the cost of operating a well, for instance.

BRIEF DESCRIPTION OF THE DRAWINGS

These and other features, aspects, and advantages of the present invention will become better understood when the following detailed description of certain exemplary embodiments is read with reference to the accompanying drawings in which like characters represent like parts throughout the drawings, wherein.

DETAILED DESCRIPTION OF SPECIFIC EMBODIMENTS

Figure 1:
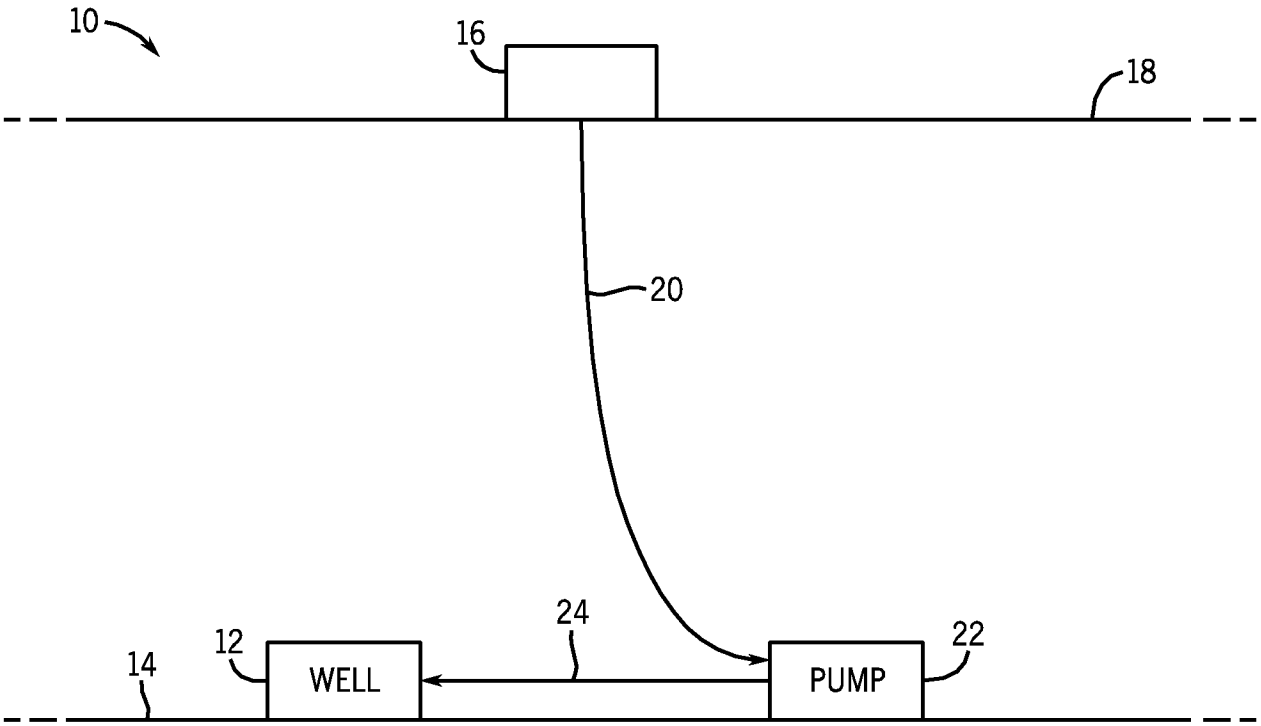
FIG. 1 is a block diagram of an exemplary resource extraction system in accordance with the disclosed embodiments.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Certain exemplary embodiments of the present invention include a chemical-injection management system that addresses one or more of the above-mentioned inadequacies of conventional chemical-injection management systems. Some embodiments may include a flow regulator that has a positive-displacement flow meter, which, as explained below, may remain accurate over longer periods of time and under a wider variety of conditions than flow meters used in conventional flow regulators. In some embodiments, the flow regulator may be configured to exercise direct, feed-forward control of a valve, without using a nested valve-positioning feedback control loop. As explained below, flow regulators exercising feed-forward control of the valve may remain accurate over longer periods of time than systems exercising feedback control, which may rely on system constants that may not be appropriate when valve components have worn or other conditions have changed.

Additionally, some embodiments may immerse components of the chemical-injection management system in a protective fluid, such as oil, to reduce wear on moving components and potentially extend their useful life. To this end, some embodiments may have a sealed housing to contain the protective fluid and a pressure equalizer to reduce hydrostatic loads in sub-sea applications, as explained below.

In addition, some embodiments may include a small, high-pressure pump placed within the chemical-injection management system, downstream of the meter but upstream of an injection point. The supply to the chemical-injection management system may be a common configuration, where the supply lines are rated at 3,000 to 10,000 pounds per square inch (psi). In particular, in certain embodiments, the supply lines may be rated at 3,000 to 5,000 psi. However, in other embodiments, the supply lines may be rated at 5,000 to 10,000 psi. The supply fluid may be monitored and throttled through the chemical-injection management system flow meter at a low pressure, after which the pressure of the supply fluid may be increased near the injection point to a high-pressure line. For example, in certain embodiments, the pressure of the supply fluid may be increased to 10,000 to 15,000 psi. However, in other embodiments, the pressure of the supply fluid may be increased to 15,000 to 20,000 psi, or even greater, depending on the application.

Using the present embodiments, standard low-pressure umbilicals and existing infrastructure and equipment may be used, given that the pressures will not increase until the pump termination/interface point. The supply fluid may also be metered and throttled at lower pressures using existing equipment since the increases in pressure occur downstream of the existing equipment. Prior to addressing these features in detail, aspects of a system that may employ such a chemical-injection management system are discussed.

FIG. 1 depicts an exemplary sub-sea resource extraction system 10. In particular, the sub-sea resource extraction system 10 may be used to extract oil, natural gas, and other related resources from a well 12, located on a sub-sea floor 14, to an extraction point 16 at a surface location 18. The extraction point 16 may be an on-shore processing facility, an off-shore rig, or any other extraction point. The sub-sea resource extraction system 10 may also be used to inject fluids, such as chemicals, steam, and so forth, into the well 12. These injected fluids may aid the extraction of resources from the well 12.

As sub-sea resource extraction systems 10 become more complex, reach greater depths, extend to greater offshore distances, and operate at higher pressures, the auxiliary equipment which supply working fluids to these sub-sea resource extraction systems 10 increase in complexity as well. The working fluids may be supplied to the sub-sea equipment using flexible jumper or umbilical lines. The systems may be comprised of reinforced polymer and small diameter steel supply lines, which are interstitially spaced into a larger reinforced polymer liner. As the working pressure of the sub-sea equipment increases, the supply pressures and injection pressures also increase. This increase in supply pressure may require that the umbilical assemblies also be reinforced and re-engineered around the higher pressures.

However, given that the materials for the systems may be polymers, increasing the working pressure may lead to an increase in the size of the equipment, which can become quite large. Additionally, as the pressure increases, the small diameter steel tubing may also be modified through thicker wall sections. However, in order to maintain cross-sectional flow area through the umbilicals, the inner diameter (ID) of the equipment should not decrease. This may lead to additional wall thicknesses. Therefore, the stiffness and weight of the system may also increase. These increases may cause the system to be more expensive, include additional weight, and decrease configurability on the sea floor while increasing overall handling difficulties.

However, using the present embodiments, low-pressure (e.g., between 3,000 and 5,000 psi) umbilicals 20 may be used to deliver the fluids to the well 12. As illustrated in FIG. 1, instead of delivering the fluids directly to the well 12, a pump 22 may be located upstream of the well 12 at or near the sub-sea floor 14. The pump 22 may be used to increase the pressure of the fluids before delivery of the fluids to the well 12. In addition, in certain embodiments, high-pressure (e.g., approximately 10,000-20,000 psi) equipment 24 may be used to deliver the higher pressure fluids to the well 12. By using the pump 22 to increase the pressure of the fluids at or near the sub-sea floor 14, the umbilicals 20 used may be rated at lower pressures.

Figure 2:
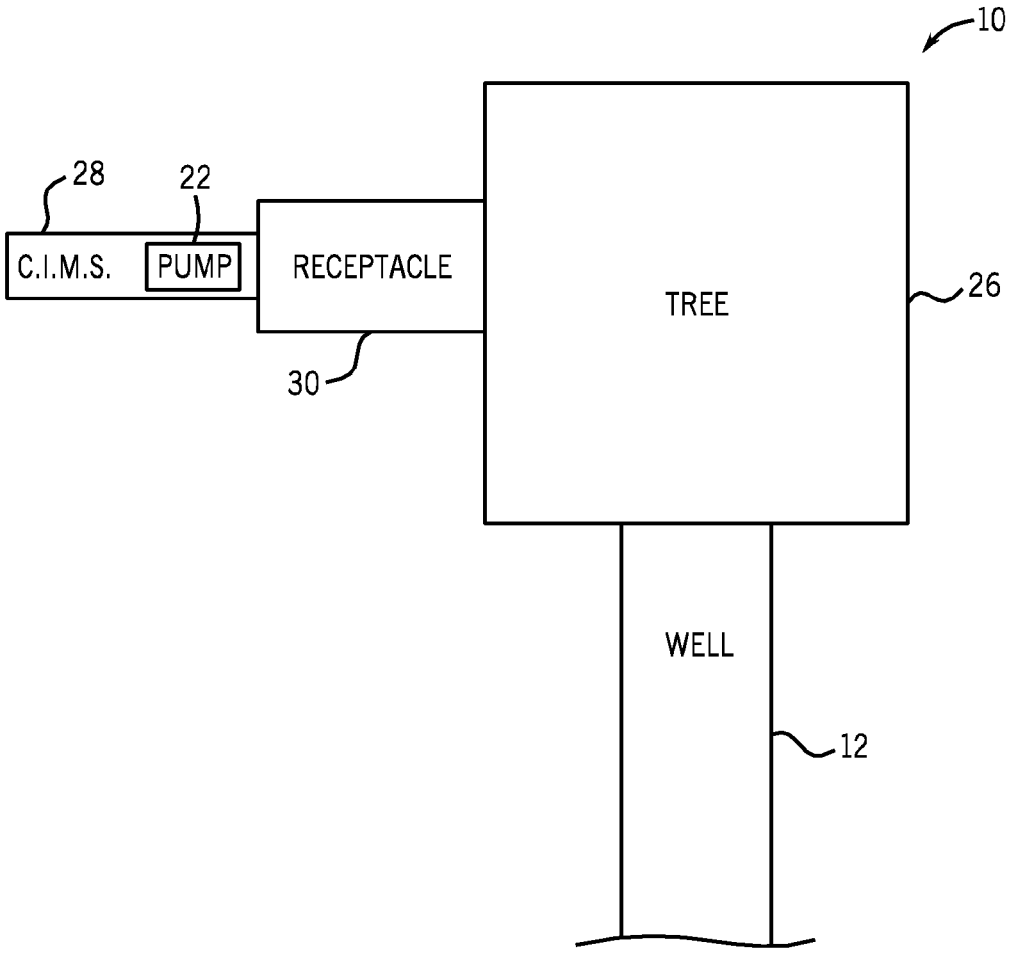
FIG. 2 is a block diagram of an exemplary resource extraction system in accordance with the disclosed embodiments.

FIG. 2 depicts an exemplary resource extraction system 10, which may include a well 12, what is colloquially referred to as a "christmas tree" 26 (hereinafter, a "tree"), a chemical-injection management system (C.I.M.S.) 28, and a valve receptacle 30. The illustrated resource extraction system 10 may be configured to extract hydrocarbons (e.g., oil and/or natural gas). When assembled, the tree 26 may couple to the well 12 and include a variety of valves, fittings, and controls for operating the well 12. The chemical-injection management system 28 may be coupled to the tree 26 via the valve receptacle 30. The tree 26 may place the chemical-injection management system 28 in fluid communication with the well 12. As explained below, the chemical-injection management system 28 may be configured to regulate the flow of a chemical through the tree 26 and into the well 12. However, although the presently disclosed embodiments are primarily directed toward the regulation of pressure and flow of chemicals injected into a sub-sea well 12, the chemical-injection management system 28 may also be extended for use with a wide variety of working fluids and in various types of systems, such as hydraulic systems.

In addition, as also explained below, the chemical-injection management system 28 may include the pump 22, which may be used to increase the pressure of the chemicals downstream of metering equipment within the chemical-injection management system 28 but upstream of an injection point into the tree 26 and the well 12. For example, the pressure of the chemicals may be increased by at least 10, 20, 30, 40, 50, 60, 70, 80, 90, 100, 150, 200, 300, 400, 500%, and so forth. In certain embodiments, this entire range of pressure ratios may not be attainable by any particular chemical-injection management system 28. Rather, the specific range of pressure ratios which may be attained by the chemical-injection management system 28 may generally be a project-specific selection. In other words, in a certain project-specific embodiment, the pressure ratios attainable by the chemical-injection management system 28 may be between 20% and 100% whereas, in another project-specific embodiment, the pressures ratios attainable by the chemical-injection management system 28 may be between 150% and 400%.

Figure 3:
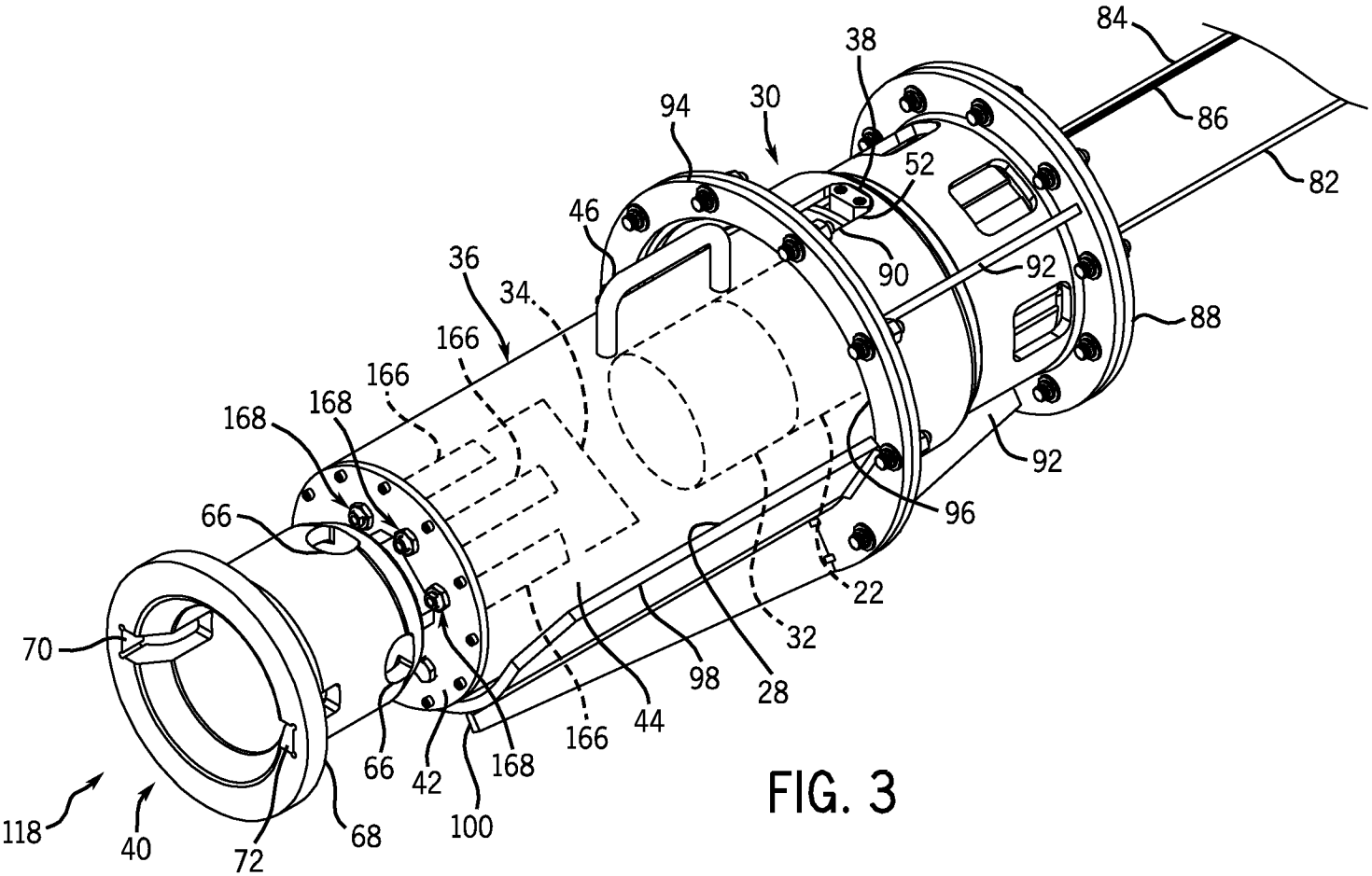
FIG. 3 is a partial perspective view of the resource extraction system of FIG. 2 that depicts an exemplary chemical-injection management system and a valve receptacle in accordance with the disclosed embodiments.

FIG. 3 is a perspective view of the chemical-injection management system 28, mated with the valve receptacle 30. As illustrated, the chemical-injection management system 28 may include the pump 22, a flow regulator 32, a pressure equalizer 34, a housing 36, a tree interface 38, and an ROV (remotely operated vehicle) interface 40. As described in reference to FIGS. 6-8, the pump 22 may be used to increase the pressure of the chemicals prior to injection into the well. In addition, the flow regulator 32 may include components that reduce the likelihood of the flow regulator 32 losing accuracy over time. Furthermore, the pressure equalizer 34 may facilitate the inclusion of a protective fluid, which is believed to extend the life of moving components within the housing 36. Prior to addressing these features in detail, other components of the chemical-injection management system 28 are discussed.

Figure 4:
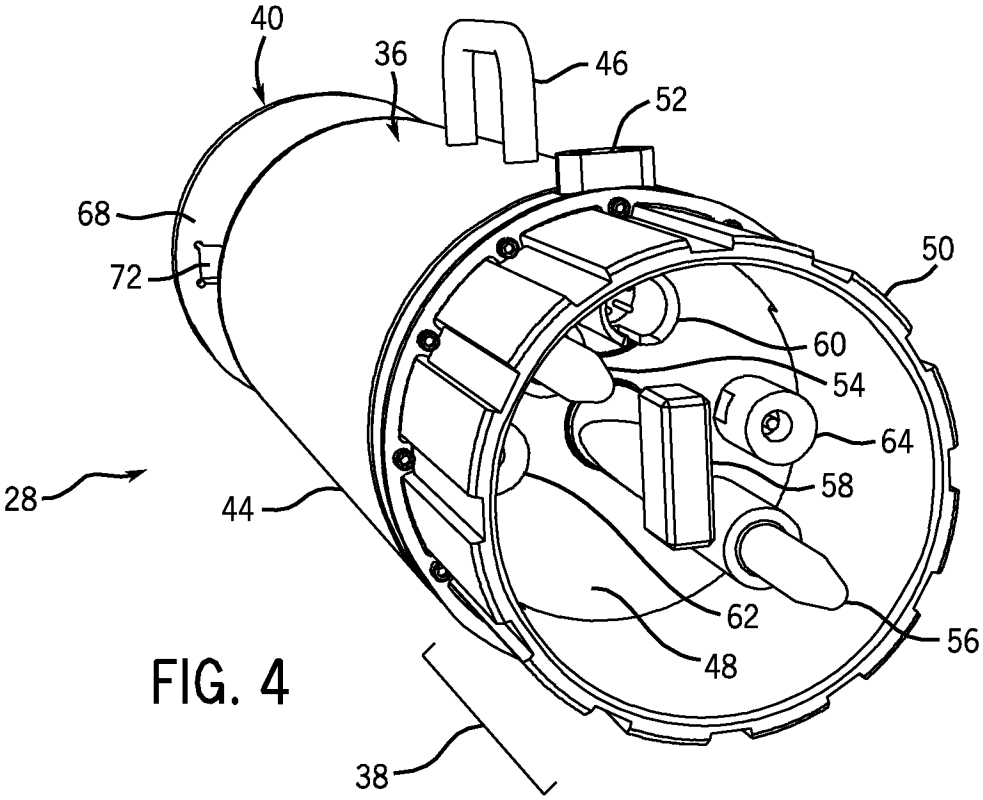
FIG. 4 is a rear-perspective view of the chemical-injection management system of FIG. 3.

With reference to FIGS. 3 and 4, the housing 36 may include an outer-end plate 42, a side wall 44, a handle 46, an inner-end plate 48, and a tree-interface shield 50. The side wall 44 and end plates 42 and 48 may be made from a generally rigid, corrosion-resistant material and may generally define a right cylindrical volume with a circular base. The tree-interface shield 50 may extend from the side wall 44 beyond the inner-end plate 48. The handle 46 may be affixed (for example, welded) to the side wall 44 and may have a U-shape. Some embodiments may include additional handles 46.

As illustrated by FIGS. 3 and 4, the tree interface 38 may include a key 52, guide pins 54 and 56, a latch 58, an electrical connector 60, a fluid-inlet connector 62, and a fluid-outlet connector 64. In the present embodiment, with the exception of the key 52, the components of the tree interface 38 may be generally disposed within the tree-interface shield 50. These components may be configured to electrically, fluidly, and/or mechanically couple the chemical-injection management system 28 to the tree 26 via complementary components on the valve receptacle 30, as explained below after discussing the ROV interface 40.

Figure 6:
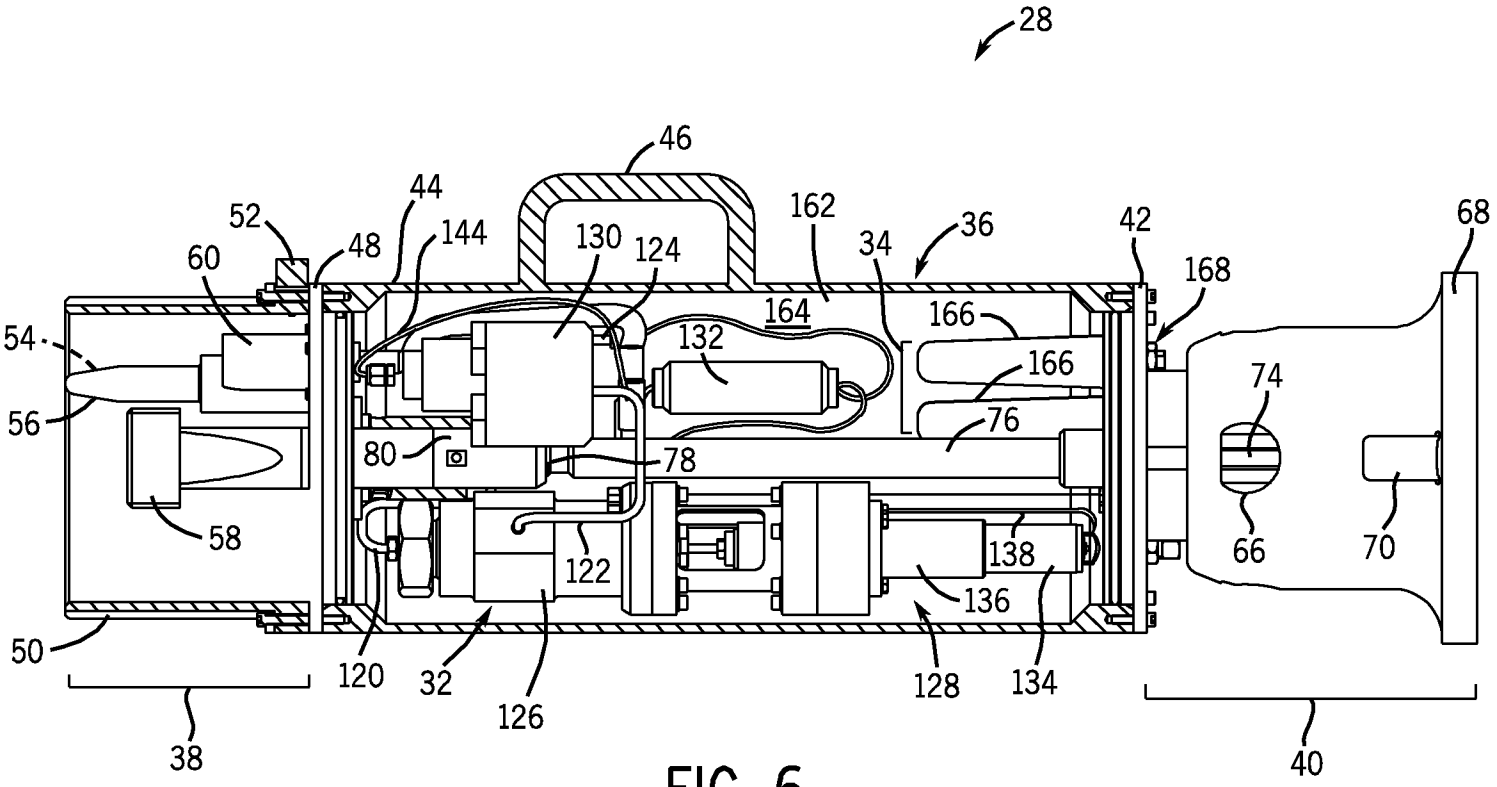
FIG. 6 is a cutaway view of the chemical-injection management system of FIG. 3.

The ROV interface 40 will now be described with reference to FIGS. 3 and 6. The illustrated ROV interface 40 may include apertures 66, a flared grip 68, slots 70 and 72, and a torque-tool interface 74. In some embodiments, the ROV interface 40 may be an API 17D class 4 ROV interface. The ROV interface 40 may be attached to the outer-end plate 42. The torque-tool interface 74, which may be configured to couple to a torque tool on an ROV, may be disposed within the flared grip 68 and generally symmetrically between the slots 70 and 72. As illustrated by FIG. 6, the torque-tool interface 74 may be coupled to an internal drive mechanism that includes a driveshaft 76, a threaded coupling 78, and a cam 80 that is linked to the latch 58. The operation of these components will be described after discussing features of the valve receptacle 30.

Figure 5:
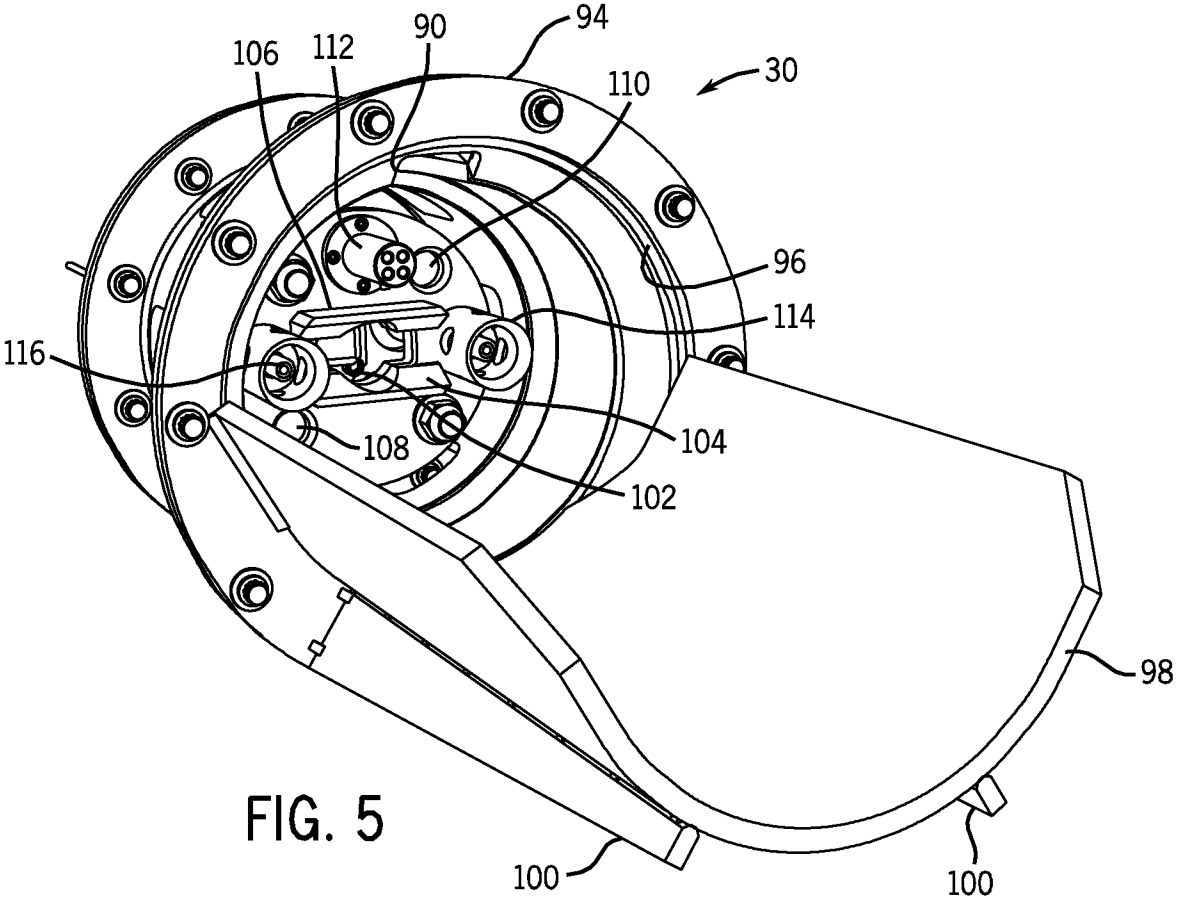
FIG. 5 is a perspective view of the valve receptacle of FIG. 3.

FIGS. 3 and 5 illustrate the exemplary valve receptacle 30. Starting with the features depicted by FIG. 3, the valve receptacle 30 may include a fluid inlet 82, a fluid outlet 84, an electrical connection 86, a mounting flange 88, a keyway 90, support flanges 92, an outer flange 94, a valve aperture 96, a valve tray 98, and tray supports 100. The fluid inlet 82 may be a fluid conduit, tube, or pipe that is in fluid communication with a fluid source, such as a supply of a liquid to be injected, and the fluid outlet 84 may be a fluid conduit, tube, or pipe that is in fluid communication with the well 12. Using the pump 22 within the chemical-injection management system 28 may generally allow a large majority of the components in the chemical-injection management system 28 downstream of the fluid inlet 82 to be lower pressure (e.g., cheaper and lighter) components. More specifically, higher pressure (e.g., more expensive and heavier) components may generally not be required until downstream of the fluid outlet 84, after the pressure of the chemicals has been increased. The ability of the chemical-injection management system 28 to use lower pressure components is one of the benefits of the disclosed embodiments.

The electrical connection 86 may couple to a power source, a user input device, a display, and/or a system controller. The mounting flange 88 may be configured to couple the valve receptacle 30 to the tree 26. The keyway 90 and the valve tray 98 may be configured to at least roughly align the chemical-injection management system 28 to the valve receptacle 30 during an installation of the chemical-injection management system 28. Specifically, the valve tray 98 may be configured to support the chemical-injection management system 28 as it slides into the valve aperture 96, and the key 52 may be configured to slide into the keyway 90 to rotationally position the chemical-injection management system 28.

Turning to the features illustrated by FIG. 5, the valve receptacle 30 may include a slot 102, lead-in chamfers 104 and 106, chamfered apertures 108 and 110, a complementary electrical connector 112, a complementary fluid-inlet connector 114, and a complementary fluid-outlet connector 116. In the present embodiment, these components may be disposed within the valve aperture 96. The lead-in chamfers 104 and 106 and the slot 102 may be configured to align and receive the latch 58 from the chemical-injection management system 28, and the chamfered apertures 108 and 110 may be configured to receive the guide pins 54 and 56, respectively. Additionally, the complementary fluid-inlet connector 114 may be configured to fluidly couple the fluid inlet 82 to the fluid-inlet connector 62, and the complementary fluid-outlet connector 116 may be configured to fluidly couple the fluid outlet 84 to the fluid-outlet connector 64. The complementary electrical connector 112 may be configured to electrically couple the electrical connector 60 on the chemical-injection management system 28 to the electrical connection 86.

During installation, the chemical-injection management system 28 may be secured to an ROV above or near the surface of the ocean, e.g., on a support structure or vessel. The ROV may then submerge and convey the chemical-injection management system 28 to the tree 26 and place it on the valve tray 98. The ROV may rotate the chemical-injection management system 28 to align the key 52 with the keyway 90. The ROV may then drive the chemical-injection management system 28 forward into the valve aperture 96, as indicated by arrow 118 in FIG. 3. As the chemical-injection management system 28 moves forward, the guide pins 54 and 56 may mate or cooperate with the chamfered apertures 108 and 110 to further refine the alignment of the chemical-injection management system 28. With further forward movement, the latch 58 may be inserted through the slot 102 with the aid of the lead in chamfers 104 and 106.

As illustrated in FIG. 6, to form the electrical and fluid connections, a torque tool on the ROV may then rotate the torque-tool interface 74, which may rotate the driveshaft 76 within the cam 80. The cam 80 may transmit approximately the first 90° of rotation of the driveshaft 76 into rotation of the latch 58, thereby positioning the latch 58 out of alignment with the slot 102 and generally preventing the latch 58 from being pulled back through the slot 102. After 90° of rotation, the cam 80 may generally cease transmitting rotation of the driveshaft 76, and the threaded coupling 78 may convert rotation of this driveshaft 76 into a linear translation or pulling of the latch 58 back towards the housing 36. However, because the latch 58 is out of alignment with the slot 102, it may be generally prevented from moving backwards by the valve receptacle 30. As the latch 58 is pulled backwards, the chemical-injection management system 28 may gradually translate forward, and the electrical and fluid connections may be formed. Finally, the ROV may disengage from the chemical-injection management system 28 and return to the surface.

Figure 7:
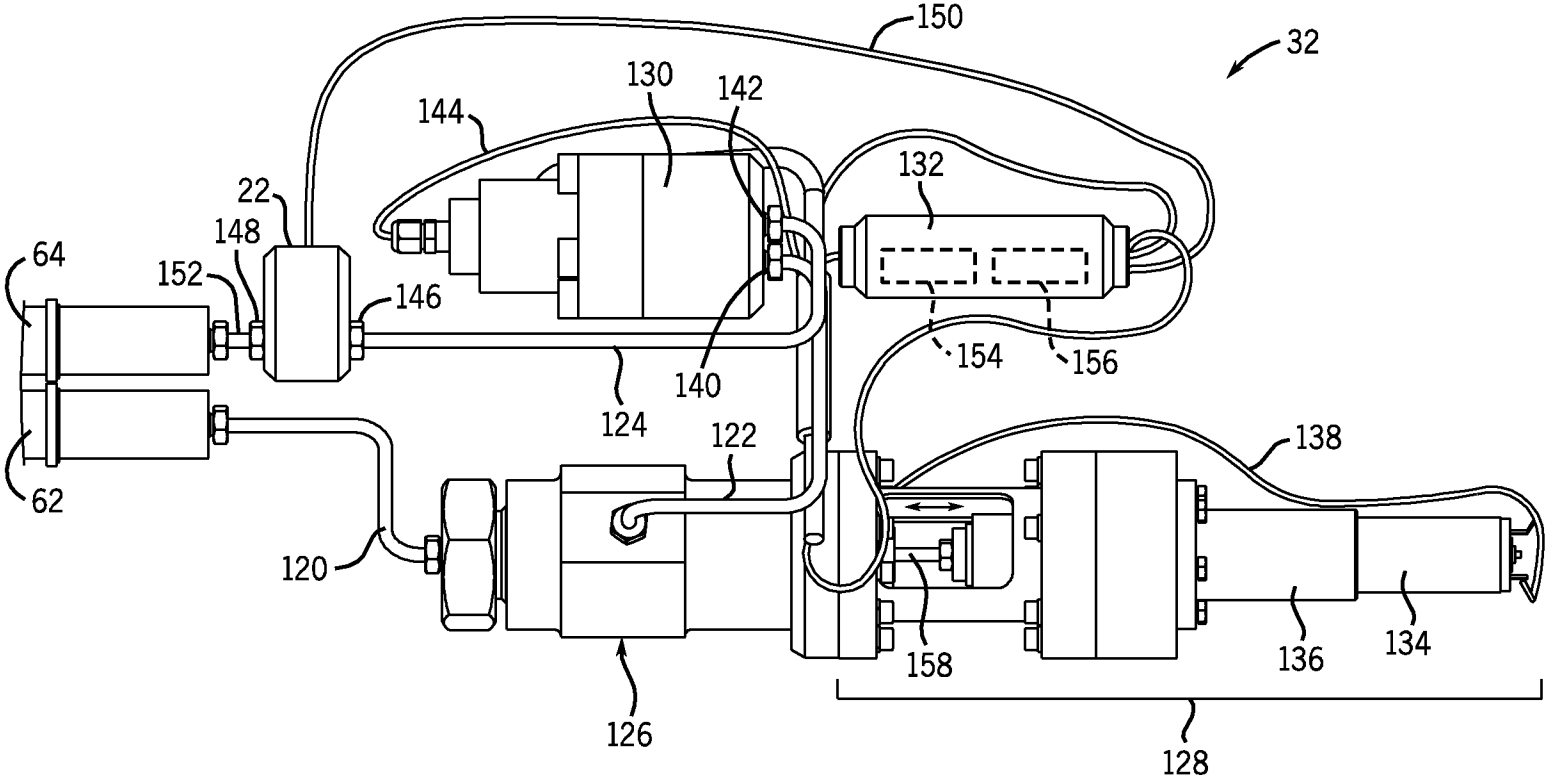
FIG. 7 is a side-view of an exemplary flow regulator and associated pump in accordance with the disclosed embodiments.
Figure 8:
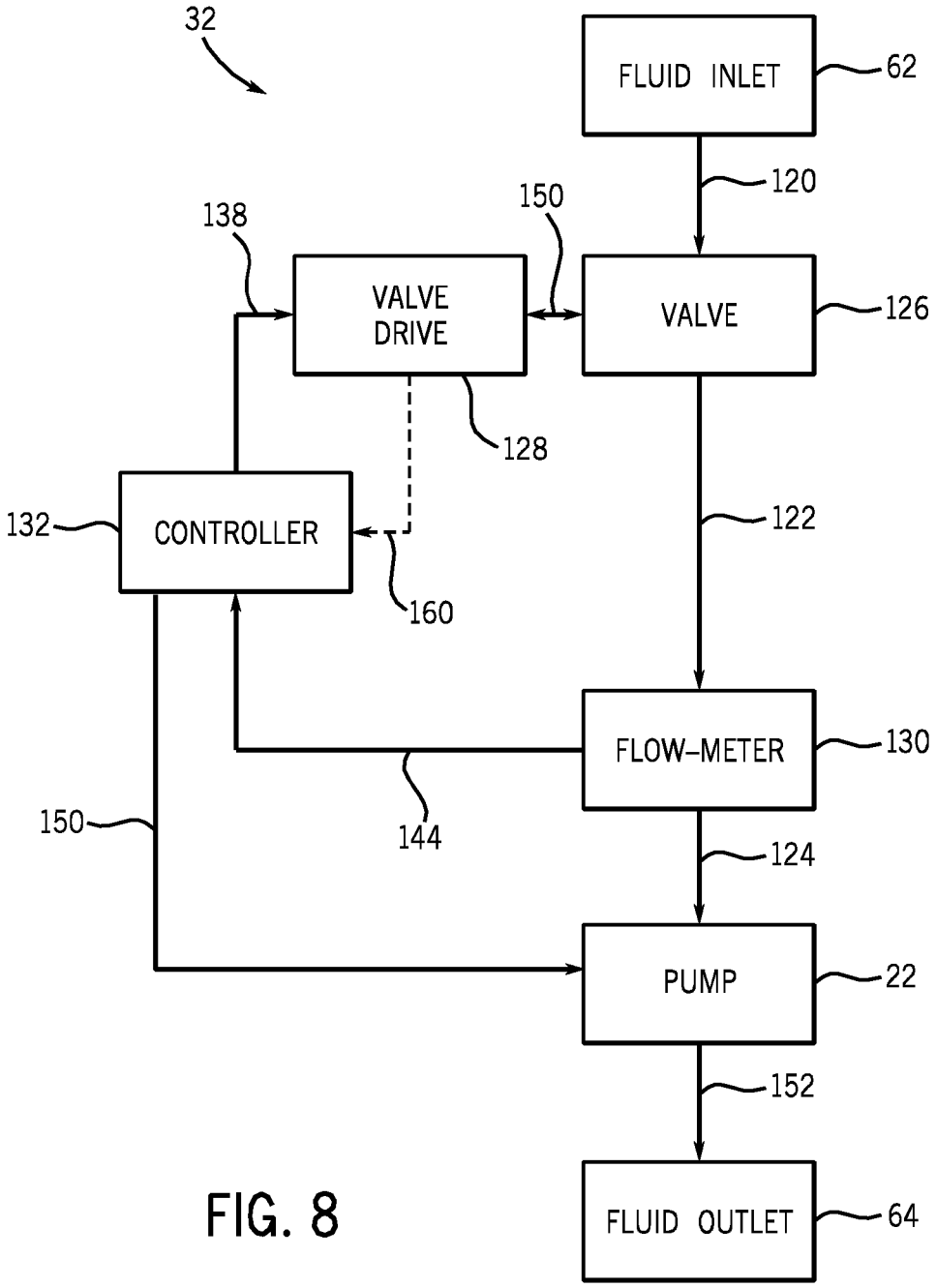
FIG. 8 is a flow chart of the flow regulator and associated pump of FIG. 6.

Features of the flow regulator 32 will now be described with reference to FIGS. 6-8. FIG. 6 illustrates the flow regulator 32 within a cutaway portion of the housing 36, and FIG. 7 illustrates the flow regulator 32 in isolation. FIG. 8 is a flow chart of the flow regulator 32 and associated pump 22.

Turning to FIG. 7, the flow regulator 32 may include fluid conduits 120, 122, and 124, a valve 126, a valve drive 128, a flow meter 130, and a controller 132. As explained below, the flow regulator 32 may be configured to regulate or control a flow parameter, such as a volumetric flow rate, a mass flow rate, a volume, and/or a mass of fluid flowing into the well 12.

The illustrated valve drive 128 may include a motor 134, a gearbox 136, and a control signal path 138. The motor 134 may have a direct-current (DC) motor, for instance, a 20-24 volt DC electric motor with. In certain embodiments, the gearbox 136 includes a high power ratio planetary gearbox with a gear ratio in excess of 600:1. In some embodiments, these components 134 and 136 may be immersed in an oil filled environment, as explained below. Advantageously, such an environment may tend to reduce wear on these components 134 and 136.

The flow meter 130 may include a fluid inlet 140, a fluid outlet 142, and a measurement signal path 144. In some embodiments, the flow meter 130 may be a positive-displacement flow meter. That is, the flow meter 130 may be configured to directly measure a flow rate or amount by sensing a volume displaced by a fluid flowing there-through. For example, the flow meter 130 may be configured to measure the volume or flow rate of a moving fluid by dividing the fluid into generally fixed, metered volumes. The number of metered volumes may generally determine the volume and/or mass of fluid flowing there-through, and the number of metered volumes per unit time may generally determine the volumetric and/or mass flow rate of the fluid flowing there-through. In some embodiments, the flow meter 130 may include a piston and cylinder assembly, a peristaltic device, a rotary vane meter, an oval-gear meter, a vortex meter, and/or a nutating disk meter. The flow meter 130 may have a turn-down ratio greater than or equal to 100:1, 300:1, 700:1, or 1000:1. The flow meter 130 may be generally free of bearings and generally chemically resistant. Additionally, in some embodiments, the flow meter 130 may be rated for pressures greater than the 5 ksi, 10 ksi, 15 ksi, or 20 ksi.

Advantageously, a positive-displacement flow meter may exhibit less drift over long periods of time (e.g., over several years) and may maintain accuracy with a variety of different types of fluids. Because the positive-displacement flow meter 130 measures flow rates and/or volumes directly (rather than inferring flow rates and volumes from a correlation between some other parameter, such as pressure drop across an orifice plate, and flow rate) the positive-displacement flow rate meter 130 may be subject to fewer sources of error and may be easier to calibrate than other types of flow meters. However, it should be noted that in other embodiments other types of flow meters may be employed, such as a differential pressure flow meter.

In addition, the pump 22 may include a pump fluid inlet 146, a pump fluid outlet 148, and a pump control signal path 150. In certain embodiments, fluid from the flow meter 130 may be directed into the pump 22 via fluid conduit 124. Within the pump 22, the pressure of the fluid may be increased before being directed to the fluid outlet 64 via the pump outlet conduit 152. Since the fluid downstream of the pump 22 may be relatively high (e.g., 10,000-20,000 psi), the equipment downstream of the pump 22 may be configured to handle these increased pressures. Specifically, the pump fluid outlet 148, pump outlet conduit 152, fluid outlet 64, and all associated fittings, may be rated to withstand pressures as great as 20,000 psi. Conversely, the equipment upstream of the pump 22 may be designed to handle lower pressures.

The pump control signal path 150 may be used to send information relating to the operating conditions of the pump 22 to the controller 132. For instance, in certain embodiments, the controller 132 may be configured to adjust the speed of the pump 22 via the pump control signal path 150. As such, the controller 132 may be configured to control the flow rate of the fluid. Accordingly, in these embodiments, a flow rate meter 130 may not be utilized. In other words, the flow rate of the fluid may be directly controlled by a variable-speed pump 22 controlled by the controller 132. However, in other embodiments utilizing a controllable variable-speed pump 22, the flow rate meter 130 may be used in conjunction with the pump 22.

In certain embodiments, the pump 22 may be a piezoceramic stack actuator. These types of pumps are generally characterized as being somewhat small and capable of relatively low volume yet high frequency pump displacement. In other embodiments, the pump 22 may be any suitable device capable of increasing the pressure of the fluid from relatively low (e.g., approximately 3,000-5,000 psi) inlet pressures to relatively high (e.g., approximately 10,000-20,000 psi) outlet pressures. In particular, in certain embodiments, the pump 22 may be capable of displacing a relatively small volume of fluid at a relatively high frequency (e.g., 5000, 7500, 10000 Hz, or even higher).

The controller 132 may include a processor 154 and memory 156. The controller 132 may be configured to determine a volumetric flow rate, a mass flow rate, a volume, or a mass based on a signal from the flow meter 130. The controller 132 may also be configured to regulate or control one or more of these parameters based on the signal from the flow meter 130 by signaling the motor 134 to adjust the position of the needle 158. The controller 132 may also be configured to regulate the operation of the pump 22 based on signals transmitted through the pump control signal path 150. To this end, the controller 132 may include software and/or circuitry configured to execute a control routine, such as a proportional-integral-differential (PID) control routine. In some embodiments, the control routine and/or data based on the signal from the flow meter 130 may be stored in memory 156 or another computer-readable medium.

FIG. 8 is a diagrammatic representation of the flow regulator 32. Starting with the connections configured to convey fluids, the fluid-inlet connector 62 may be fluidly coupled to the threaded inlet of the valve 126 by fluid conduit 120. The fluid outlet manifold of the valve 126 may be fluidly coupled to the fluid inlet 140 of the flow meter 130 by the fluid conduit 122. Additionally, the fluid outlet 142 of the flow meter 130 may be fluidly coupled to the pump fluid inlet 146 of the pump 22 by fluid conduit 124. In addition, the pump fluid outlet 148 of the pump 22 may be fluidly coupled to the fluid-outlet connector 64 by pump outlet conduit 152. Additionally, the needle 158 mechanically links the valve drive 128 and the valve 126.

Turning to the connections configured to convey information, data, and/or control signals, the controller 132 may be communicatively coupled to the flow meter 130 by measurement signal path 144 and to the valve drive 128 by control signal path 138. In addition, the controller 132 may be communicatively coupled to the pump 22 by pump control signal path 150. Additionally, the controller 132 may be communicatively coupled to the electrical connector 60 for communication with other components of the resource extraction system 10 and for a source of power.

In operation, the controller 132 may exercise feedback control over fluid flow through the flow regulator 32. The controller 132 may transmit a control signal to the valve drive 128. The content of the control signal may be determined by, or based on, a comparison between a flow parameter (e.g., a volumetric flow rate, a mass flow rate, a volume, or a mass) measured by the flow meter 130 and a desired value of the flow parameter. For instance, if the controller 132 determines that the flow rate through the flow regulator 32 is less than a desired flow rate, the controller 132 may signal the valve drive 128 to withdraw the needle 158 some distance. In response, the motor 134 may drive the gearbox 136, and the gearbox 136 may convert rotational movement from the motor 134 into linear translation of the needle 158. As a result, in some embodiments, the flow rate through the valve 126 may increase as the gap between the tapered tip of the needle 158 and the narrowed fluid path of the needle seat increases. Alternatively, if the controller 132 determines that the flow rate (or other flow parameter) through the flow regulator 32 is greater than a desired flow rate (or other flow parameter), the controller 132 may signal the valve drive 128 to drive the needle 158 some distance into the valve 126, thereby potentially decreasing the flow rate. In other words, the controller 132 may signal the valve drive 128 to move the needle 158 some distance based on a flow parameter sensed by the flow meter 130.

To control the flow parameter, the controller 132 may exercise feedback and/or feed-forward control of the valve drive 128. For instance, in some embodiments, the controller 132 may receive a drive feedback signal 160 that is indicative of, or correlates with, the position of the needle 158. Using the drive feedback signal 160, the controller 132 may exercise feedback control over the position of the needle 158. That is, the controller 132 may send a control signal 138 that is determined, at least in part, by a comparison between the drive feedback signal 160 and a desired needle position. The desired needle position may be determined by a table, equation, and/or relationship stored in memory 156 that correlates needle position with flow rate through the valve 126. Embodiments employing feedback control over both the position of the needle 158 and the flow parameter may be characterized as having a nested control loop, e.g., a feedback control loop directed toward controlling the needle position nested within a feedback control loop directed towards controlling the flow parameter.

Some embodiments may not include a nested control loop or may employ a nested control loop in a more limited fashion. For instance, in some embodiments, the controller 132 may not receive the drive feedback signal 160 or may partially or entirely disregard the drive feedback signal 160. In certain embodiments, the controller 132 may exercise feed-forward control over the position of the needle 158. That is, the controller 132 may transmit control signal 138 to the valve drive 128 based on a difference between a desired flow parameter value and a measured flow parameter value, regardless of a current position of the needle 158. In other words, some embodiments may not rely on a stored correlation between needle position and flow rate through the valve 126. For instance, in operation, the controller 132 may determine that the current volumetric flow rate through the flow regulator 32 is less than the desired volumetric flow rate and, in response, signal the valve drive 128 to shift the position of the needle 158 some distance. In some embodiments, the controller 132 may determine this distance without regard to the current position of the needle 158.

Advantageously, embodiments without a nested control loop may control flow parameters more accurately over a longer period of time and under a wider variety of circumstances than conventional systems. Because some embodiments do not rely on a correlation between the position of the needle 158 and a flow rate through the valve 126, they may be more robust in the face of changing conditions. For example, the tapered tip of the needle 158 or the narrowed fluid path of the needle seat may wear and change the relationship between the position of the needle 158 and the flow rate through the valve 126. Such a change could introduce error when exercising feedback control of the position of the needle 158. In some circumstances, this error could decrease the responsiveness, stability, or accuracy of the flow regulator 32. In contrast, embodiments without a nested control loop for controlling the position of the needle 158 may be affected less by these sources of error.

With respect to the flow meter 130, certain positive-displacement flow meters are believed to have improved reliability (i.e., improved accuracy or precision over time) because they measure flow directly rather than infer flow rate from a correlation between some other parameter (such as a pressure drop across an orifice plate) and flow rate. Such positive-displacement flow meters may be robust and responsive to changes in the relationship between the parameter and flow rate. Further, embodiments that do not exercise feedback control over the degree to which the valve is open or closed (or at least, direct, nested feedback control of valve position) may be robust and responsive to changes in the relationship between flow rate and valve position.

With respect to the pump 22, any suitable device capable of increasing the pressure of the fluids flowing through the chemical-injection management system 28 from a relatively low (e.g., approximately 3,000-5,000 psi) inlet operating pressure to a relatively high (e.g., approximately 10,000-20,000 psi) outlet operating pressure may be used. For example, in certain embodiments, the pump 22 may be capable of displacing a small volume of fluid at relatively high frequencies (e.g., 5000, 7500, 10000 Hz, or even higher), such as piezoceramic stack actuators. In addition, the pump 22 may not be limited to a constant pressure output. For instance, the pump 22 may capable of operating at constantly variable pressures, or using pressure steps, and so forth. Specifically, the pump 22 may be controlled by the controller 132, allowing for adjustment of the output pressure of the chemical-injection management system 28, giving the operator increased flexibility in the use of the equipment.

Other features of the chemical-injection management system 28 may tend to extend its useful life. For example, returning to FIG. 6, an interior 162 of the housing 36 may be partially or substantially entirely filled with a protective fluid 164, such as oil. In some embodiments, the protective fluid 164 may be hydraulic gear oil. Advantageously, the protective fluid 164 may lubricate and/or tend to reduce wear on components inside the housing 36, such as the driveshaft 76, the cam 80, the threaded coupling 78, and/or the valve drive 128. To maintain separation of sea water and the protective fluid 164, the housing 36 may be substantially watertight. In some sub-sea applications, a difference in pressure between the protective fluid 164 and surrounding sea water may exert a hydrostatic load on the housing 36. To reduce this load, the chemical-injection management system 28 may include a pressure equalizer 34.

Features of the exemplary pressure equalizer 34 will now be described with reference to FIGS. 3 and 6. The pressure of equalizer 34 may include one or more bladders 166 and fittings 168. The pressure equalizer 34 may extend inward into the housing 36 from the outer-end plate 42. Some embodiments may include 1, 2, 3, 4, 5, or more bladders. The bladders 166 may be made of a resilient and/or watertight material, such as rubber, neoprene, vinyl, or silicone. The bladders 166 may have a generally cylindrical shape and couple to the fitting 168 at one end.

In operation, the pressure equalizer 34 may tend to reduce a difference in pressure between the protective fluid 164 and surrounding water pressure. If the water pressure is greater than the pressure of the protective fluid 164, the bladders 166 may expand and/or apply a force to the protective fluid 164 and increase the pressure of the protective fluid 164, thereby potentially reducing the pressure differential. In some embodiments, the protective fluid 164 may be substantially incompressible and the bladders 166 may primarily transmit a force rather than expand to equalize pressure. Some embodiments may include other types of pressure equalizers 34, such as a piston disposed within a cylinder that is in fluid communication with the protective fluid 164 and surrounding seawater on opposite sides of the piston. In another embodiment, the pressure equalizer 34 may include a resilient or less rigid portion of the housing 36 that is configured to transmit a force to the protective fluid 164.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus, comprising:

a chemical-injection management unit of a sub-sea oil and gas extraction system, comprising:

a chemical path having a chemical inlet and a chemical outlet;

a pump disposed in the chemical path between the chemical inlet and the chemical outlet; wherein the pump is configured to increase the pressure of a chemical flow through the chemical path;

a watertight housing having the chemical inlet and the chemical outlet, wherein the chemical path and the pump are disposed within the watertight housing, and the watertight housing is configured to block water leakage at a sub-sea location; and a pressure equalizer disposed between an exterior and an interior of the watertight housing, wherein the pressure equalizer is configured to substantially equalize an interior pressure at the interior with an exterior pressure at the exterior.

2. The apparatus of claim 1, wherein the pump comprises a piezoceramic stack actuator.

3. The apparatus of claim 1, comprising a tree interface coupled to the watertight housing, wherein the tree interface comprises the chemical inlet, the chemical outlet, a power connector, and a mechanical connector configured to couple with a tree of the sub-sea oil and gas extraction system.

4. The apparatus of claim 1, comprising at least one of a meter or a valve disposed in the watertight housing along the chemical path between the chemical inlet and the pump, wherein the pump is configured to increase the pressure of the chemical flow from an inlet pressure up to approximately 5,000 pounds per square inch to an outlet pressure up to approximately 20,000 pounds per square inch.

5. The apparatus of claim 1, wherein the chemical-injection management unit comprises a motorized valve disposed in the watertight housing along the chemical path between the chemical inlet and the chemical outlet.

6. The apparatus of claim 5, wherein the chemical-injection management unit comprises a flow meter disposed in the watertight housing along the chemical path between the chemical inlet and the chemical outlet.

7. The apparatus of claim 6, wherein the chemical-injection management unit comprises a controller communicatively coupled to the pump, the flow meter, and the motorized valve, wherein the controller is disposed within the watertight housing.

8. The apparatus of claim 7, wherein the controller is configured to exercise feedback control of a parameter of fluid flow through the flow path based on a feedback signal from the flow meter without exercising feedback control of a position of the motorized valve, and the controller is configured to exercise feed-forward control of the position of the motorized valve based on a difference between a desired value of the parameter and a value of the parameter indicated by the feedback signal.

9. The apparatus of claim 1, wherein at least a substantial portion of the interior of the watertight housing is filled with a protective fluid.

10. The apparatus of claim 9, wherein the pressure equalizer is configured to substantially equalize the interior pressure of the protective fluid the exterior pressure of water at the exterior.

11. An apparatus, comprising:

a fluid injection management unit, comprising:

a housing;

a fluid path extending through the housing from a fluid inlet to a fluid outlet, a tree interface coupled to the housing, wherein the tree interface comprises the fluid inlet, the fluid outlet, a power connector, and a mechanical connector configured to couple the fluid injection management unit to a tree of a sub-sea well; and a pump disposed within the housing along the fluid path, wherein the pump is configured to increase the pressure of a fluid flowing along the fluid path.

12. The apparatus of claim 11, wherein the pump comprises a piezoceramic stack actuator.

13. The apparatus of claim 11, wherein the pump is configured to at least double the pressure of the fluid, and the fluid injection management unit comprises at least one of a meter or a valve disposed within the housing along the fluid path between the fluid inlet and the pump.

14. The apparatus of claim 11, wherein an interior of the housing is at least partially filled with a protective fluid, wherein the fluid injection management unit comprises a pressure equalizing bladder disposed between an exterior and the interior of the housing, and the pressure equalizing bladder is configured to substantially equalize an interior pressure of the protective fluid with a water pressure at the exterior.

15. The apparatus of claim 11, wherein the fluid comprises a hydraulic fluid or a chemical.

16. A method, comprising:

receiving a chemical flow into a chemical-injection management unit at a subsea location proximate a subsea well; and increasing the pressure of the chemical flow within the chemical-injection management unit at the subsea location, wherein the chemical-injection management unit comprises at least one of:

a housing having a pressure equalizer configured to substantially equalize an interior pressure with an exterior pressure; or an interface having a chemical inlet, a chemical outlet, a power connector, and a mechanical connector configured to couple with equipment at the subsea location;

a combination thereof.

17. The method of claim 16, wherein increasing the pressure within the chemical-injection management unit comprises increasing the pressure of the chemical flow by at least a factor of two at the subsea location.

18. The method of claim 16, comprising delivering the chemical flow from the chemical-injection management unit into the sub-sea well via a tree, wherein the chemical-injection management unit is coupled to the tree via the interface having the chemical inlet, the chemical outlet, the power connector, and the mechanical connector.

19. The method of claim 18, comprising controlling the pressure of the chemical flow by adjusting a speed of a variable-speed pump within a housing of the chemical-injection management unit.

20. The method of claim 16, comprising:

sensing a parameter of the chemical flow through the chemical-injection management unit with a positive-displacement flow meter disposed within a housing of the chemical-injection management unit; and controlling at least one of a valve or a pump disposed within the housing of the chemical-injection management unit in response to the sensed parameter.

21. The method of claim 16, comprising sensing a parameter of the chemical flow via a meter disposed within a housing of the chemical-injection management unit, and increasing the pressure of the chemical flow with a pump disposed within the housing downstream from the meter.

22. The method of claim 16, comprising pressure equalizing the housing of the chemical-injection management unit via the pressure equalizer.

23. An apparatus, comprising:

a chemical-injection management unit of a sub-sea oil and gas extraction system, comprising:

a chemical path having a chemical inlet and a chemical outlet;

a pump disposed in the chemical path between the chemical inlet and the chemical outlet; wherein the pump is configured to increase the pressure of a chemical flow through the chemical path; and a watertight housing having the chemical inlet and the chemical outlet, wherein the chemical path and the pump are disposed within the watertight housing, and the watertight housing is configured to block water leakage at a sub-sea location a tree interface coupled to the watertight housing, wherein the tree interface comprises the chemical inlet, the chemical outlet, a power connector, and a mechanical connector configured to couple with a tree of the sub-sea oil and gas extraction system.

24. An apparatus, comprising:

a fluid injection management unit, comprising:

a housing;

a fluid path extending through the housing from a fluid inlet to a fluid outlet, a tree interface coupled to the housing, wherein the tree interface comprises a mechanical connector configured to couple the fluid injection management unit to a tree of a sub-sea well;

a pump disposed within the housing along the fluid path, wherein the pump is configured to increase the pressure of a fluid flowing along the fluid path; and a pressure equalizer disposed between an exterior and an interior of the housing, and the pressure equalizer is configured to substantially equalize an interior pressure with an exterior pressure.

* * * * *